US007735872B1

(12) United States Patent
Arkwright

(10) Patent No.: US 7,735,872 B1
(45) Date of Patent: Jun. 15, 2010

(54) ADHESIVE FASTENER ASSEMBLY AND METHOD FOR REMOVABLY MOUNTING PAPERS

(76) Inventor: George A. Arkwright, 9105 Chickawane Ct., Alexandria, VA (US) 22309

( * ) Notice: Subject to any disclaimer, the term of this patent is extended or adjusted under 35 U.S.C. 154(b) by 1045 days.

(21) Appl. No.: 11/395,311

(22) Filed: Apr. 3, 2006

Related U.S. Application Data

(63) Continuation-in-part of application No. 10/685,529, filed on Oct. 16, 2003, now abandoned.

(51) Int. Cl.
*B42D 5/00* (2006.01)

(52) U.S. Cl. ..... 281/45; 281/21.1; 281/38; 428/40.1

(58) Field of Classification Search ..... 402/8, 402/60, 79; 281/15.1, 21.1, 23, 28, 38, 45; 462/71, 75; 428/40.1
See application file for complete search history.

(56) References Cited

U.S. PATENT DOCUMENTS 2,277,318 A * 3/1942 Grant ..... 281/22
4,650,706 A * 3/1987 Emmel ..... 428/40.1
4,768,810 A * 9/1988 Mertens ..... 462/26
4,822,074 A * 4/1989 Hueffman et al. ..... 281/15.1
5,050,909 A * 9/1991 Mertens et al. ..... 283/81
5,169,254 A * 12/1992 Arkwright ..... 402/8
5,248,164 A * 9/1993 Lepretre ..... 281/22
5,275,286 A * 1/1994 Bader ..... 206/455
5,524,929 A * 6/1996 Emmel et al. ..... 281/21.1
5,575,574 A * 11/1996 Mertens ..... 400/118.2
6,153,278 A * 11/2000 Timmerman et al. ..... 428/40.1
6,447,196 B1 * 9/2002 Arkwright ..... 402/8
6,514,585 B1 * 2/2003 Pearson et al. ..... 428/40.1
6,719,475 B2 * 4/2004 Arkwright ..... 402/8

* cited by examiner

*Primary Examiner*—Dana Ross
*Assistant Examiner*—Pradeep C Battula
(74) *Attorney, Agent, or Firm*—Shlesinger, Arkwright & Garvey LLP

(57) ABSTRACT

A paper receiving assembly and method provide immediate paper mounting, by presenting an uncovered contact adhesive for engaging a paper.

21 Claims, 5 Drawing Sheets

ADHESIVE FASTENER ASSEMBLY AND METHOD FOR REMOVABLY MOUNTING PAPERS

CROSS-REFERENCE TO RELATED APPLICATIONS

This application is a continuation-in-part of U.S. patent application Ser. No. 10/685,529, filed Oct. 16, 2003, now abandoned.

FIELD OF THE INVENTION

This invention relates to a flexible adhesive fastener for filing papers, introduced in my U.S. Pat. No. 5,169,254, dated Dec. 8, 1992, and my U.S. Pat. No. 6,447,196, dated Sep. 10, 2002.

A group of relatively small superposed and flexible adhesive fasteners are mounted in a flap-like manner, along the central top edge of a file folder panel. A strip of contact adhesive on each one of the adhesive fasteners engages the upper section of a paper to be filed.

This method of mounting papers in a file folder avoids the need to punch holes in the papers. A paper is filed more quickly. There is no need for use of a two-hole punch. Any one paper alone can be removed from the file without disturbing any other file papers.

BACKGROUND OF THE INVENTION

The prior adhesive fasteners were two-hole punched and placed on the prongs on a conventional paper file folder prong fastener. The adhesive fasteners are rectangular, paper-thin plastic pieces. Each of the adhesive fastener pieces have a longitudinally extending commercially available contact adhesive tape. The tape has a permanent type contact adhesive which holds the tape to the adhesive fastener surface. The other lower surface of the tape has a medium tack contact adhesive which engages a paper to be filed. Previously, the medium tack contact adhesive surface was covered by a removable covering piece which was removed immediately prior to inserting the paper to be filed.

The medium tack adhesive provides sufficient strength to securely hold a paper in the file. The medium tack contact adhesive also permits a given adhesive fastener to be quickly peeled free of the file paper to which it is attached. Unlike a prong mounted file paper, a single adhesive fastener file paper alone can be removed individually from its adhesive fastener. None of the other papers in the file must be removed.

But the cost of the fasteners, dependence on a metal prong for support of the fasteners, difficulty in separating the adhesive fastener to be used, and removal of the small contact adhesive covering strip, prevented to wider use of the adhesive fastener.

The original adhesive fastener design has found a small niche market where the fasteners are used to file papers that should not be two hole punched. The adhesive fasteners previously were mounted individually on conventional metal prongs.

With the realization that smaller adhesive fasteners could adequately hold papers, and that a packet of fasteners could adequately support a group of papers without relying on conventional metal prongs for support, other specialized uses, as well as the possibility of more acceptance for general filing were possible.

With a new product, convenience and utility factors must substantially outweigh the cost of its use.

This invention is directed to providing substantial improvement in convenience and use of an adhesive fastener, and lower fastener costs.

SUMMARY OF INVENTION

This invention provides an adhesive fastener assembly which will have greater general acceptance of adhesive fasteners for filing papers. It provides faster and easier adhesive fastener filing of papers than previously. There is no longer a need for a contact adhesive covering piece. Manufacturing the adhesive fastener packet of this invention is less expensive. The thin adhesive fastener packet can be used in both conventional file folders, and in thin, flat binders.

Papers are filed by merely pressing up the bottom edges of the file adhesive fasteners with a fingertip, and then inserting the paper to be filed. There is no need to remove and dispose of a contact adhesive covering piece.

The recognition that the last used adhesive fastener was anchored down by its file paper, and could be used as a separating and contact adhesive covering piece for the adjacent unattached adhesive fastener above it, is both the basis for the new adhesive fastener packet design and filing method.

Placement of a non-adherable surface on each adhesive fastener in alignment with the contact adhesive on the adjacent adhesive fastener permits successive adhesive fasteners above the last used adhesive fastener to immediately receive and engage the next paper to be filed.

The interaction of adjacent fasteners eliminates the need for a separate adhesive covering piece for the contact adhesive surface of each adhesive fastener.

Merely the upward fingertip flip of the adhesive fasteners above the last filed paper allows for immediate insertion of the next paper to be filed. There is no cover piece to be removed from the fastener contact adhesive. Removal and disposal of the contact covering piece had been a nuisance.

Additionally, the simplified construction of the adhesive packet assembly reduces costs. Material and production costs are important considerations for a product where the purchase price must be nominal.

The adhesive fastener assembly of this invention enables papers, brochures, and notes, to be slipped into place and also individually removed when desired. In this respect, the adhesive fastener assembly of this invention can provide a flat, thin binder, which is easier to use than conventional 3-metal ring binders currently on the market.

The fingertip engagement separation step for paper filing, and substantial reduction in expense for an adhesive fastener, will permit its entry into the general retail market.

These and other further advantages will become apparent from the following description of the invention.

DESCRIPTION OF THE INVENTION

Figure 1:
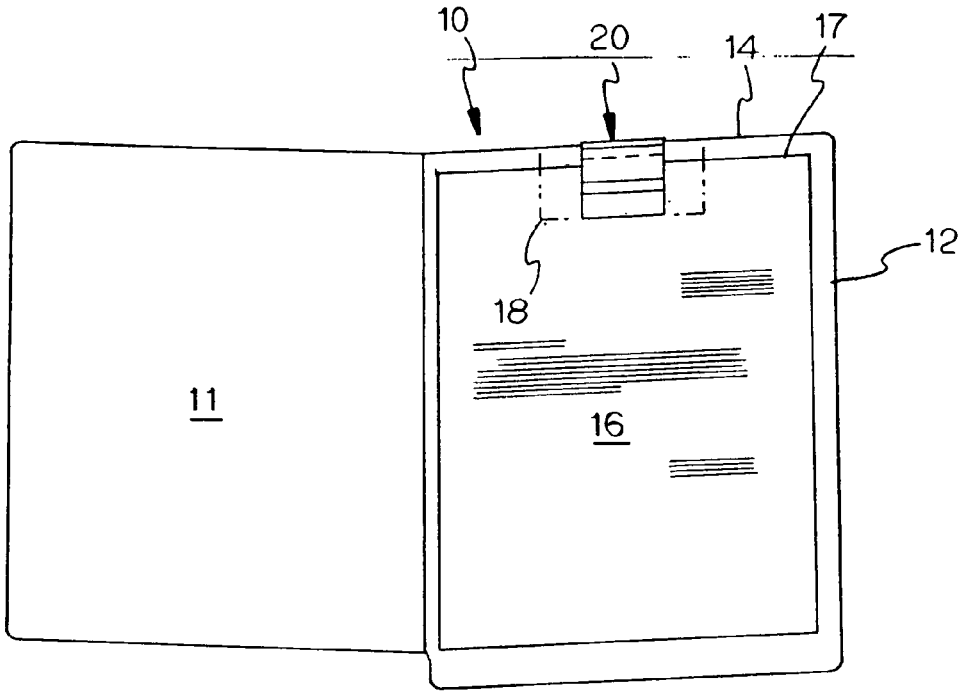
FIG. 1 is a plan view of the adhesive fastener assembly mounted on the panel of a file folder.

FIG. 1 shows a two panel shelf type file folder 10, having a covering panel 11 and a backing panel 12. The panel 12 has an upper edge 14. A file paper 16 is mounted on the backing panel as shown, in alignment with the backing panel 12. The upper edge 17 of the file paper is only a small distance, about a quarter inch from the upper edge 14 of the panel 12, and extends parallel to it.

The dotted outline 18 shows the adhesive fastener outline which would ordinarily be occupied by the previous adhesive fastener designs, which are mounted on conventional metal prongs. The adhesive fastener packet of this invention, generally indicated at 20, is firmly attached to the backing panel 12 at its central section along the upper edge 14. Significantly, it is half the length of the previous prong mounted adhesive fastener.

The new adhesive fastener packet 20, permits the file paper 16 to be mounted within the confines of the panel without extending below the bottom edge of the adjacent panel 11. The adhesive fastener packet is sufficiently strong to hold the papers firmly in position without permitting any skewing or misalignment.

Figure 2:
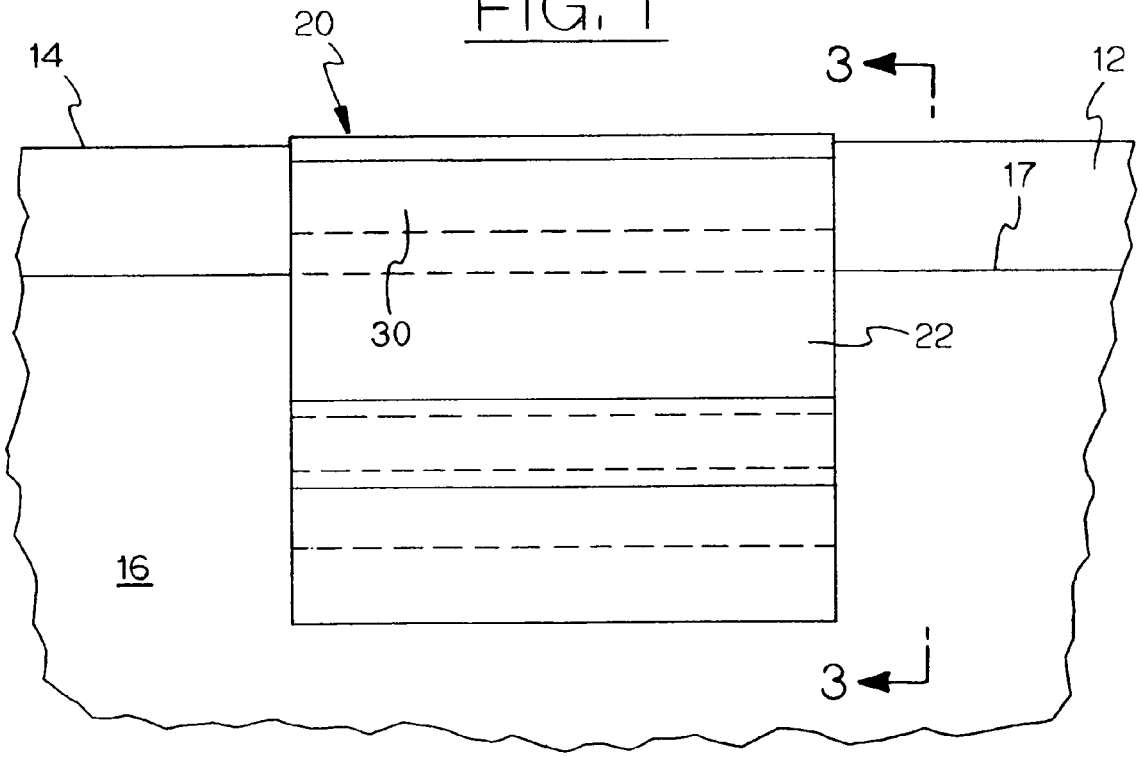
FIG. 2 is an enlarged plan view of the adhesive fastener assembly of FIG. 1.
Figure 3:
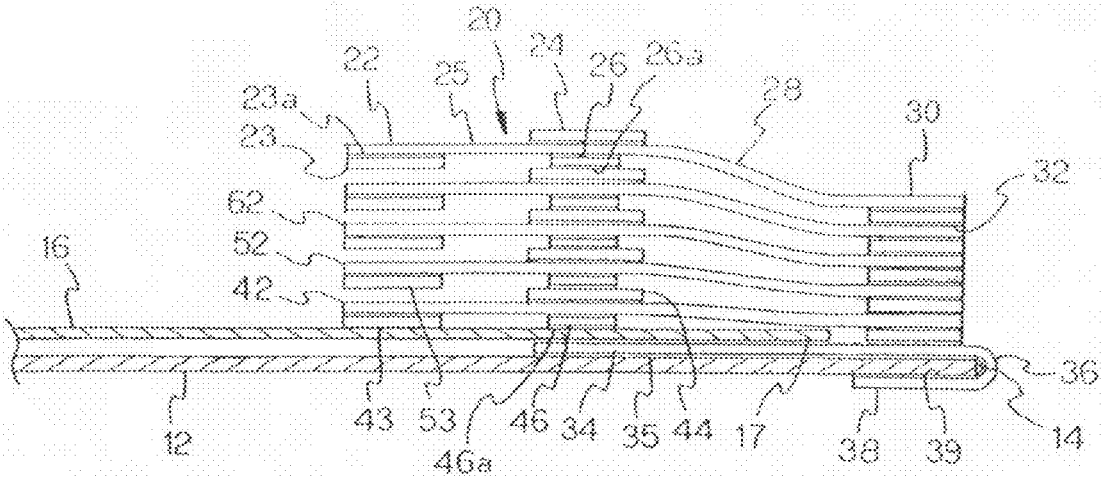
FIG. 3 is a cross-sectional view along line 3-3 of FIG. 2 showing a side view of the mounted adhesive fastener assembly of FIG. 2.

The detailed construction and mounting arrangement of the adhesive fastener packet 20 is shown in FIGS. 2 and 3. The adhesive fasteners are rectangular, paper thin plastic pieces, such as polypropylene, polyethylene or acetate film. They are of identical construction and are held together in superposed alignment at their top section.

Referring to FIGS. 2 and 3, the uppermost adhesive fastener 22 is identical in construction with the adhesive fastener pieces below it. It has a bottom finger engageable free section. A clear one quarter inch wide adhesive tape 23 extends across the undersurface of the lower free edge. The tape stiffens the section and enables the fingertip of the user to readily separate and to lift and separate the lower most fastener.

A strip of five-eighths inch wide non-adhereable tape 24 has a permanent contact adhesive on its lower surface adhered to the upper surface of the adhesive fastener 22. The strip of tape 24 extends longitudinally across the central section of fastener 22. The upper surface of the non-adhereable strip of tape 24 has a non-adhereable surface for example, a silicone coating to which contact adhesive will not adhere.

The open horizontal area 25 between the release tape 24 and the one quarter inch wide reinforcing tape strip 23 is slightly less than a quarter of an inch wide. It provides a flexible longitudinally extending composite-bending section 23, 25.

A two-sided strip of contact adhesive tape 26 slightly more than one-eighth inch wide, is disposed on the undersurface of fastener 22 and is aligned with the non-adhereable strip of tape 24. It has a permanent high tack adhesive (about 25 ounces) on its upper surface which is adhered to the undersurface of the fastening piece 22. It is disposed immediately under and in alignment with the non-adhereable strip of tape 24 on the fastener upper surface. The contact adhesive tape undersurface has a contact adhesive coating **26*a*** of medium tack adhesive. The medium tack contact adhesive is preferably in the range of approximately 8 to 16 ounces.

The strip of contact adhesive provides a long and narrow line of contact adhesive about one eighth of an inch wide. This line of contact adhesive **26*a* provides adequate adhesive capacity to prevent the file paper from either being pulled out of the file, or from peeling away from the adhesive fastener when the file papers are folded back over the top of the mounting panel 12**. However, when the adhesive fastener is pulled upwardly away from the surface, perpendicularly from the surface of the filed paper, to which the fastener is attached, the adhesive readily disengages, permitting the file paper to be removed.

When the identical adhesive fastener pieces are assembled and aligned above one another as a packet 20, the contact adhesive layer **26*a*** rests on, and is covered by the corresponding release surface of the adjacent adhesive fastener below it.

The intermediate section 28 between the non-adhereable strip of tape 24 and the top section 30 is approximately one-half inch wide, and provides a bendable hinge section. The adhesive fasteners are held together in a stack by double coated high tack one quarter inch wide tape 32. The fasteners are stacked and aligned in superposed position as shown in FIG. 3. They are held together by the double coated adhesive strip of tape 32. The lowermost of the double coated strips of tape 32 of the fastener packet engages a label 34. Label 34 has a removable release liner (not shown) on its undersurface, which is removed prior to attachment of the packet to the panel 12.

FIG. 3 is a side view of the packet 20. The adhesive fastener immediate sections 28 are connected to the top section 30 and provide a hinge section for turning the file papers back over the top of the mounting panel 12. The top section 30 of the fasteners are connected together by high tack double coated permanent adhesive tape 32. The bottom tape 32 engages the label 34, which fastens the entire packet 20 to the mounting panel 12. It has a high tack permanent contact adhesive layer 35 for engaging the surface of the mounting panel 12. Additionally, it has an extended section 38 which bends around the top edge 14 of panel 12 at 36 and under it as is shown at 38 so that the adhesive 39 can engage the surface of the bottom panel 12.

Figure 4:
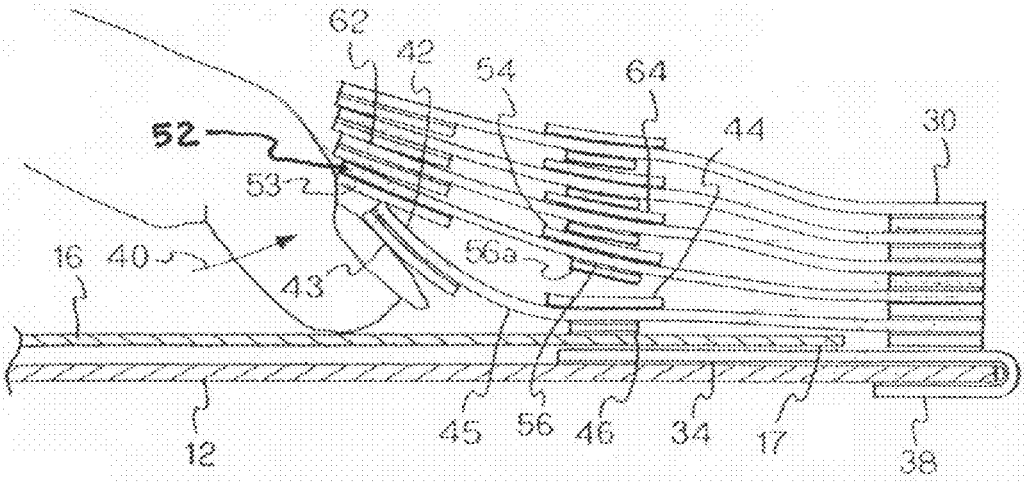
FIG. 4 is a cross-sectional side view of the mounted adhesive fastener assembly similar to FIG. 3 showing the initial step for inserting a file paper.

The lower most adhesive fastener 42 has the free upwardly bendable section. The medium tack contact adhesive coating **46*a* of tape 46 is in engagement with the upper central section of the file paper 16. The non-adhereable strip of tape 44 on adhesive fastener 42 is aligned with the contact adhesive tape 56 of fastener 52 (FIG. 4). The adhesive coating 56*a* rests on the non-adhereable surface of the non-adhereable strip of tape 44. The medium tack contact adhesive coating 56*a*, although directly resting on the non-adhering surface of the strip of non-adhering tape 44**, will not adhere to the non-adhereable surface. This is true for each of the adhesive fasteners in the assembly.

There is no need for a covering strip on the medium tack adhesive strip of an adhesive fastener. When the fasteners are separated from each other to receive a file paper, the adhesive that is to engage the file paper is also immediately exposed and is ready to engage the surface of the file paper. See FIG. 5.

This arrangement eliminates the prior need for a separate cover piece for the contact adhesive. In this event, the contact adhesive is immediately exposed.

Previously, when the adhesive fastener to be used was bent upwardly to permit insertion of the file paper, it was necessary to remove the release tape covering strip which covered the contact adhesive coating. This invention recognizes if there is a packet of aligned fasteners, the release cover piece initially required, for the adhesive strip, can be eliminated. By aligning a release coating surface on the underlying adhesive fastener with the contact adhesive on the adhesive fastener above it, a cover piece for the contact adhesive surface is unnecessary.

This invention also recognizes that, for the user, the separation of the lowermost unattached fastener could be simplified. It was realized that the lower fastener, with the contact adhesive, is held down by the file paper to which it is attached. When the adhesive fastener above it is raised it provides space for insertion of the new paper to be filed. It also exposes its contact adhesive surface. It was subsequently recognized also that the free end section of the lower attached adhesive fastener could simply be bent up to bring about separation of these two fasteners, and exposure of contact attached adhesive in a simple push upward on the free end section of the lower adhesive fastener.

FIG. 4 illustrates the separation action. The adhesive fastener 42 is held down because of its attachment to the previously filed paper 16. But all of the adhesive-fasteners above it are free to move upward.

Figure 5:
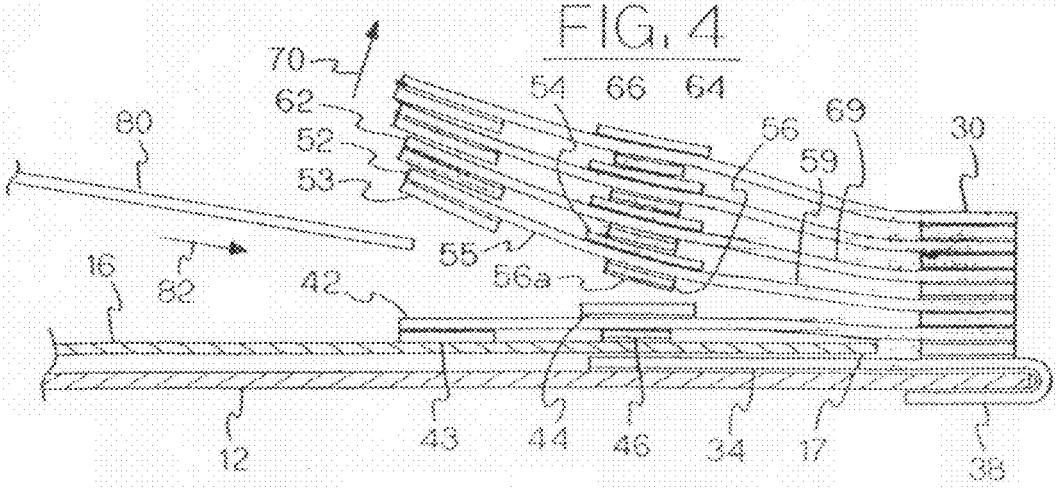
FIG. 5 is a side view of the adhesive fastener of the assembly similar to FIGS. 3 and 4, cross-sectional view showing a file paper being inserted.

FIGS. 4 and 5 illustrate the manner of adding a file paper. They show the steps involved in fastening a new paper 80 to the lower most unattached adhesive fastener 52. A previously fastened paper 16 is shown connected to lowermost adhesive fastener 42. FIGS. 4 and 5 show the sequence of the lift and insert steps respectively in the installation of a file paper. Adhesive file fastening piece 42 and adhesive fastener 52 immediately above it are both of identical construction as adhesive fastener 22, previously described. The corresponding parts of these two adhesive fastener pieces 42 and 52, correspond to the numbered elements of adhesive fastener 22. For example, the non-adhereable tape 24 of adhesive fastener 22 corresponds to the non-adhereable tape 44 of adhesive fastener 42. Similarly non-adhereable tape 54 of the adhesive fastener 52 corresponds to tape 24 of adhesive fastener 22.

FIG. 5 shows the situation after the adhesive fastener 52 is raised and separated from the adhesive fastener 42. The contact adhesive surface 56*a* is immediately exposed for contacting the incoming file paper.

This construction avoids the need to reach under the raised adhesive fastener to remove the cover strip on the contact adhesive surface. The need to remove such a strip before the adhesive fastener could be affixed, was a major nuisance and drawback to general use of the previous type adhesive fastener.

It was an additional nuisance to dispose of the removed cover strip itself. The elimination of the need for removal of the cover strip is a major simplification for the user.

Further, the ordinary adhesive fastener itself is a thin flexible plastic, such as polypropylene or acetate about the thickness of a sheet of paper, two (2) mils. The fastener has a longitudinal length of about one and three quarter inches. Separation of one adhesive fastener from another was not previously quick and immediate. To expedite finger engagement and separation, the free end of the fasteners was thickened by the application of a strip of adhesive to the free, bottom end of the adhesive fasteners as shown at 23, 43 and 53. This provides a stiff section 43 that is bent up to push up the fasteners above it. The section preferably is no more than one-half inch so that it does not foul the contact adhesive of the adhesive fastener above it when it is bent up to separate the adhesive fasteners.

The back of the finger is used to press in and up against all of the free ends of the adhesive fasteners, including the lowest and attached adhesive fastener 42, as shown in FIG. 4.

This simple single action presses up all of the adhesive fasteners, and lifts the adhesive fastener 52 and its adhesive strip 56 free from the non-adhereable tape 44 (to which is does not adhere), as illustrated in FIG. 4. Continued upward movement allows the unattached adhesive fasteners above fastener 42 to move further upward. But, fastener 42 is held down because of its attachment to the file paper 16 by contact adhesive strip 46. The free end of adhesive fastener 42 bends at the hinge section 43, but it is held down by the file paper 16, and the fingertip brushes up and by it. This brings the free end 43 of adhesive fastener 42 to drop down into engagement with the previously filed paper 16, as shown in FIG. 5. It is then only necessary to insert, with the other hand, the end of the paper 80 under the fastener 52 and into engagement with its contact adhesive 56*a*.

Figure 6:
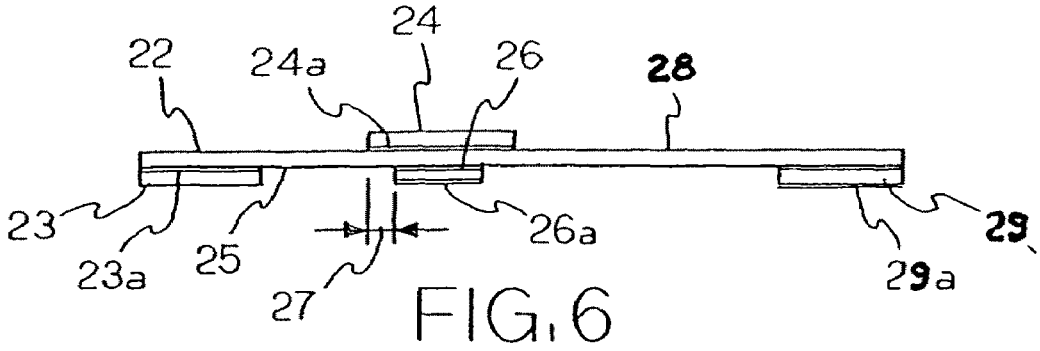
FIG. 6 is a side view of the top adhesive fastener of FIGS. 1 to 5.

FIG. 6 shows a side view of adhesive fastener 22 previously discussed with respect to FIGS. 1 to 3. Of interest are the non-adhereable strip of tape 24, and the two-sided contact adhesive strip 26. The top surface of tape 24 has a non-stick non-adhereable surface 24*a*. Contact adhesive tape 26 has a contact adhesive layer 26*a*, which preferably is an acrylic adhesive. The adhesive fastener piece 22 is preferably polypropylene, although polyethylene or similar flexible material such as acetate can be used. The surfaces of adhesive fastener 22 is preferably roughened by dyne treatment to enhance adhesion.

As discussed previously, the strip of tape 23 of the free lower end of adhesive fastener 22 gives some additional thickness which makes is easier for the user to engage with the fingertip, since the adhesive fastener is only about 2 mils thick. The strip of binding tape 29 has two layers 29*a* of high tack adhesive, one on each side, to hold the adhesive fasteners together along their top section, as previously discussed.

The differential dimension 27 is necessary to ensure that misalignment during the course of assembly will not cause any of the adhesive 26*a* to extend beyond the surface of the adjacent underlying non-adhereable non-stick coating of the adjacent adhesive fastener. This is similar in construction for all of the fasteners previously described with respect to FIGS. 1 to 5.

Figure 7:
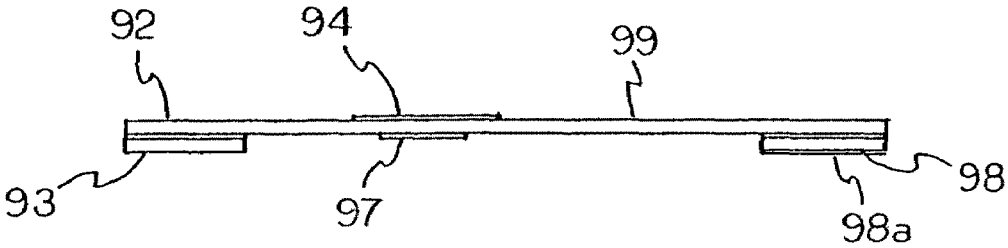
FIG. 7 is a side view of a modification of the adhesive fastener of FIG. 6.

FIG. 7 illustrates another modification of the adhesive fastener that is considered to be within the scope of the invention. Adhesive fastener 22 does not have a non-adhereable tape, nor a contact adhesive tape. The adhesive fastener 92 has a non-adhereable coating 94 of silicone, or a similar non-adhereable type coating material on the upper surface. A non-adhereable coating would be applied to the length of polypropylene adhesive fastener material, thereby eliminating need for a non-adhereable tape.

Similarly, a contact adhesive coating layer 97 could also be applied to the underside of adhesive fastener material, instead of a contact adhesive tape.

The strip of contact adhesive 97 could either be continuous or a series of discontinuous dots or blocks. It has been found that for a slightly less than a two inch length adhesive fastener, a one-eighth inch to one quarter one-quarter inch width of contact adhesive is sufficient for file use. The shorter length of a two inch strip of contact adhesive disengages from a file paper immediately on a small tug on the lower free end of the fastener. This modification, where a coating of non-adhereable material, and coating of contact adhesive to the fastener piece is less expensive than the tape strip. It also simplifies the manufacture process.

Figure 8:
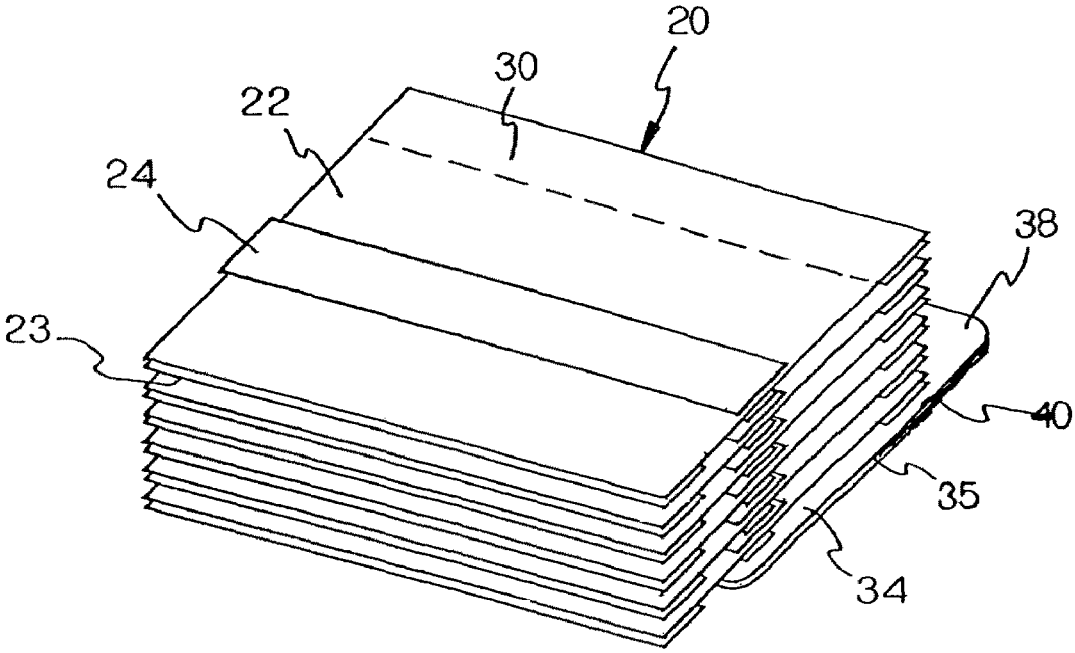
FIG. 8 is a perspective view of the adhesive fastener assembly prior to installation on a mounting panel.

FIG. 8 is a perspective view of the adhesive fastener assembly generally indicated at 20. Previously described the label 34 extends across the whole width of the fastener and down to slightly below the contact adhesive tape on the lowermost adhesive fastener. It provides a wide and extensive adhesive holding area for the label, and a good support.

The high tack permanent adhesive layer 35 on the undersurface of the label 34 is covered by a removable paper release liner 40. Note that the label section 38 extends above the top section 30 of the adhesive fasteners. The upper section 38 of the label 34 is bent over and around the mounting panel as shown in FIGS. 3, 4 and 5. This provides added holding power to prevent separation of the adhesive 35 from the mounting panel. However, if the label adhesive layer 35 is a strong permanent adhesive, the extended label section 38 will not be necessary.

Figure 9:
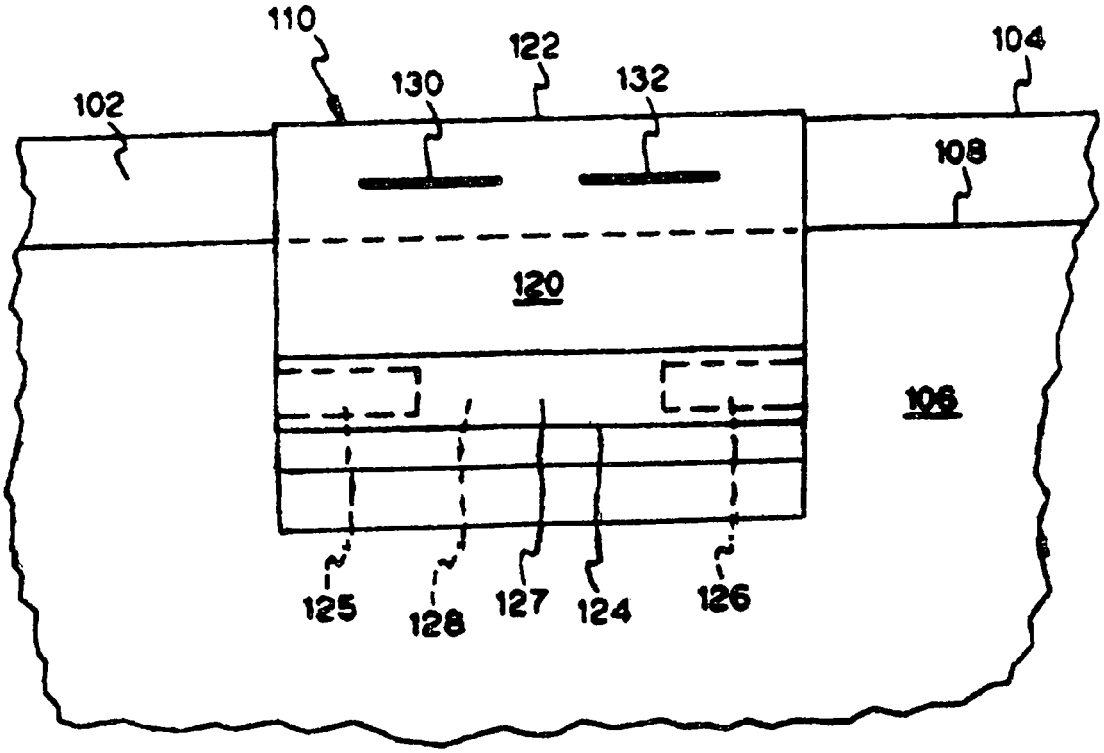
FIG. 9 is a plan view similar to FIG. 2 showing an adhesive fastener assembly with another modification of the adhesive fastener.

FIG. 9 is a top view similar to FIG. 2 showing the mounted adhesive fastener assembly 110 mounted along the upper edge 104 of the mounting panel 102. File paper 106 has an upper edge 108 that is close to (within one quarter inch) and parallel to the mounting panel upper edge 104.

The adhesive fasteners of this adhesive fastener packet are all identical to the upper fastener 120 has is typical for all. The lower surface of the adhesive fastener 120 a longitudinal discontinuous adhesive strip. It has two spaced patches 125 and 126, of a contact adhesive coating adjacent each side of the adhesive fastener 120. It extends along the lower edge of the upwardly bendable section of the fastener 120. The upper surface of the adhesive fastener 120 has either a non-adhereable coating layer, or a strip of non-adhereable tape. The staples 130 and 132 pass through all of the adhesive fasteners as well as the label (not shown) to hold the adhesive fastener assembly together. In this modification, the intermediate double-sided permanent tapes (i.e., tape 32) joining the top edge sections of the previously discussed, fasteners is omitted. This simple construction is also possible, and is within the scope of the invention.

Figure 10:
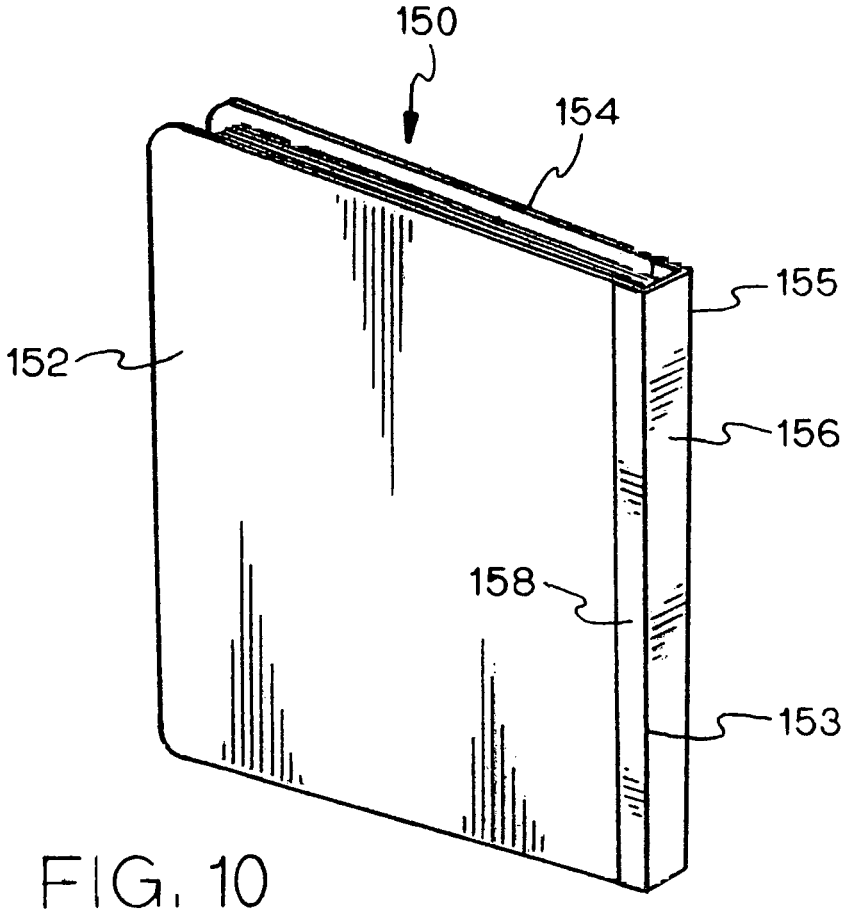
FIG. 10 is a perspective view of a closed binder assembly having the adhesive fastener packet of this invention.

The versatility of the adhesive fastener packet of this invention is illustrated by the new type of flat ringless paper binder shown in perspective FIG. 10. The adhesive fastener packet is thin. It does not require the center width of the 3-ring openable type assembly. This makes it possible to provide a flat binder which can be as small as one-half inch wide at the center of a binder.

FIG. 10 is a perspective view of an adhesive fastener assembly which is mounted on the side edge of the support panel. It is flat and thin binder.

The two side panels 152 and 154 are flat rigid pressboard or chipboard panels. They are joined together at their center edges 153 and 155 by a narrow pressboard strip 156. The two panels and the now center strip are jointed together by a tape 158. The tape wraps around the outer surfaces along the edges of all three pieces to hold them together. The tape provides a hinge arrangement at the edges 153 and 155. A similar tape arrangement is applied to the inner surface of the pressboard pieces.

Figure 11:
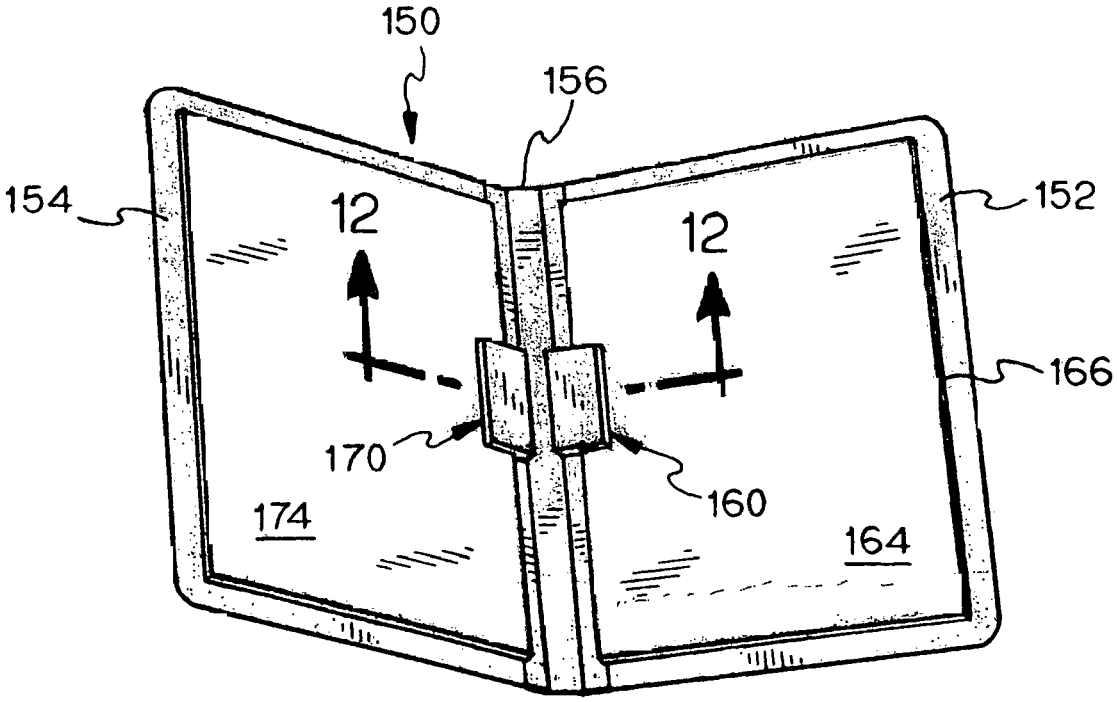
FIG. 11 is a plan view of the open adhesive fastener binder assembly of FIG. 10.

The inside of the binder is shown in the plan view of FIG. 11. Adhesive fastener packets 160 and 170 are mounted on along the inner side edges of panels 152 and 154. Papers are progressively fastened to the adhesive fasteners of the packets, as needed. Papers 164 and 174 are the most recent paper filed on the adhesive fastener packets 160 and 174.

Figure 12:
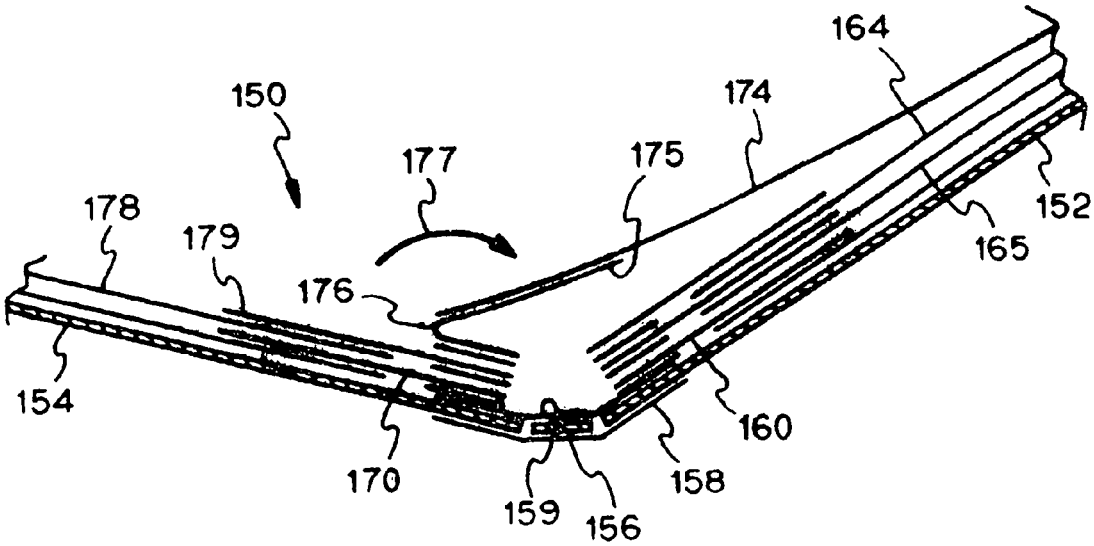
FIG. 12 is an enlarged cross sectional view along line 12-12 of FIG. 11 showing the left panel paper pivoted to present its undersurface.

FIG. 12 is a sectional view through the opened adhesive fastener assembly of FIG. 11. The manner of joining the panels 154 and 152 to the center joining strip 156 is shown. The two tape strips 158 and 159 provides the support and the hinge for the binder.

The adhesive fastener packet 160 and 170 are shown extending outwardly from the center of the binder assembly panels and joining file papers 164 and 174. Fastener 175 is shown bent over at 176. Because of the shorter length of the new adhesive fastener packets, the adhesive fastener 175 readily bends over at 176 so the paper 174 lies flat and the turned over page surface shows, in much the way of a page in a bound book. The arrow 177 shows the arcuate path of the turned page 174. This permits the attached page 174 to be viewed on both its sides. Page 178 which ordinarily underlies the page 174 is undisturbed and lies flat against the panel 179. Each of these pages are held in their normal position in the binder independently, unless like page 174 they are also turned over.

This adhesive fastener assembly, is a thin, flat binder assembly which can be conveniently carried and stacked. This is in contrast to the angular, bulky configuration of the wider typical ring binder. This new flat ringless binder is about one-half inch wide and has a capacity of about 100 sheets, and takes up less shelf space. Multi-page brochures, and stapled pages can be attached as one and are securely held. In this respect the adhesive fastener binder is very handy for a salesman or others in the field. The binder is small and compact, and no hole punching is required for fastening papers, either large or small. Papers can be effortlessly slipped into the binder or removed.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A compact multiple piece adhesive fastener assembly for quickly filing papers on a support panel, comprising:

a) a pack of superposed and aligned relatively small, paper thin, flexible adhesive fasteners for mounting file papers on a small central edge section of the support panel;

b) the adhesive fasteners being held together as a pack along a narrow common longitudinal extending top section;

c) a fastener pack supporting element connected to the adhesive fasteners at their top section to support the pack at the small central edge section edge section of the support panel in a flap-like manner;

d) each adhesive fastener having a thin strip of paper engageable medium tack contact adhesive on their lower surface;

e) the contact adhesive being substantially spaced from the top section and extending longitudinally across the length of each fastener to define a fastener intermediate flexible support section which allows simultaneous bending of many adhesive fasteners;

f) a non-adhereable covering surface on the other surface of the adhesive fasteners which is aligned with and covers the strip of medium tack contact adhesive on an adjacent adhesive fastener, to allow adjacent fasteners to readily separate from each other to immediately expose the contact adhesive; and g) the medium tack contact adhesive having sufficient separation strength to hold the adhesive fastener in contact with a file paper when adhesive fasteners are lifted to permit filing of another paper.

2. The adhesive fastener assembly as set forth in claim 1, wherein:

a) each adhesive fastener has a finger engageable upwardly bendable bottom section below and adjacent to the contact adhesive which can be bent upward by a fingertip, to b) press up and separate an adhesive fastener from an adjacent fastener attached to a file paper, to allow insertion of a paper, and its immediate engagement.

3. The adhesive fastener assembly as set forth in claim 2, wherein:

a) the upwardly bendable finger engageable bottom section has a thickened stiffer lower peripheral section to enable the user to more readily engage and grip the upwardly bendable bottom section.

4. The adhesive fastener assembly as set forth in claim 3, wherein:

a) the bendable finger engageable bottom section has a one-quarter inch wide clear tape to stiffen it.

5. The adhesive fastener assembly as set forth in claim 3 wherein:

a) the supporting element is a label having a high tack permanent contact adhesive surface for engaging the support panel; and b) a removable releasable covering piece, covering the permanent adhesive of the label.

6. The adhesive fastening assembly as set forth in claim 3, wherein:

a) the release non-stick surface is a coating which has been directly applied to the surface of the adhesive fastener.

7. The adhesive fastener assembly as set forth in claim 2, wherein:

a) the mounting panel is one of two adjacent rectangular panels which are foldably connected along their common side edge; and b) the top edge section of the adhesive fasteners are connected along the top edge central section of one of the mounting panels.

8. The adhesive fastener assembly of claim 2, wherein:

a) the mounting panel is one of the two relatively stiff rectangular panels connected along a side edge by a longitudinally extending central section, to which they are foldably connected;

b) the top section of the adhesive fasteners are mounted along the side edge of one of the mounting panels at its central sections.

9. The adhesive fastener assembly as set forth in claim 8, wherein:

a) the mounting panels are flat singular pieces of pressboard.

10. The adhesive fastener assembly of claim 8, wherein:

a) the two mounting panels and the intermediate connecting strip are held together by a length of tape which connects the panels and the intermediate connecting strip to provide two parallel foldable hinge-like connections.

11. The adhesive fastener assembly as set forth in claim 1, wherein:

a) the contact adhesive fastener has an adhesive tack which adheres to a filed paper to which it is attached to preclude disengagement during file use, but will readily disengage when a small upward pull away from the surface of the filed paper, is applied to the adhesive fastener piece.

12. The adhesive fastener assembly as set forth in claim 11, wherein:

a) the contact adhesive is an adhesive having a peel value of from 8 to 16 ounces.

13. The adhesive fastener assembly as set forth in claim 11, wherein:

a) the contact adhesive is disposed on the underside of each of the adhesive fasteners.

14. The adhesive fastening assembly as set forth in claim 1, wherein:

a) the contact adhesive is disposed in an adhesive section on the undersurface which extends longitudinally across the surface of the adhesive fasteners, and parallel to their top section.

15. The adhesive fastening assembly as set forth in claim 14, wherein:

a) the contact adhesive is a continuously extending coated layer.

16. The adhesive fastening assembly as set forth in claim 14, wherein:

a) a spaced plural contact adhesive configuration is disposed within the adhesive section.

17. The adhesive fastening assembly as set forth in claim 14, wherein:

a) the adhesive section is disposed on the underside of each adhesive fastener; and b) the contact adhesive is a continuous narrow coated strip of medium tack contact adhesive tape.

18. The adhesive fastening assembly as set forth in claim 12, wherein:

a) the length of tape disposed on the underside of the adhesive fastener and is less than five-sixteenths inch wide.

19. The adhesive fastening assembly as set forth in claim 1, wherein:

a) the non-adhereable is disposed on a continuous length of tape which is adhered to the surface of the adhesive fasteners.

20. The adhesive fastening assembly as set forth in claim 1, wherein:

a) the adhesive fasteners are rectangular pieces of plastic material approximately between one and a half to two inches in length.

21. The adhesive fastening assembly as set forth in claim 20, wherein:

a) the adhesive fastener piece is a thin plastic film approximately two mils thick; and b) the contact adhesive is an acrylic adhesive.

* * * * *